United States Patent [19]

Varon et al.

[11] 4,455,007

[45] Jun. 19, 1984

[54] HANG RAIL SUPPORT AND HANG RAIL

[75] Inventors: David S. Varon, Highland Park; Steven C. Dorner, Western Springs, both of Ill.

[73] Assignee: Crown Metal Manufacturing, Chicago, Ill.

[21] Appl. No.: 404,820

[22] Filed: Aug. 3, 1982

[51] Int. Cl.[3] ..... A47H 1/14; A47F 5/00

[52] U.S. Cl. ..... 248/251; 248/300

[58] Field of Search ..... 248/251, 315, 300; 403/346, 372; 211/105.1, 123

[56] References Cited

U.S. PATENT DOCUMENTS

| | | | |
|---|---|---|---|
| 2,646,243 | 7/1953 | Rycroft | 248/314 |
| 3,889,438 | 6/1975 | Piepers et al. | 403/346 |
| 4,316,546 | 2/1982 | Varon et al. | 248/251 |

*Primary Examiner*—William H. Schultz
*Assistant Examiner*—Ramon O. Ramirez
*Attorney, Agent, or Firm*—Silverman, Cass & Singer, Ltd.

[57] ABSTRACT

A hang rail support and bracket is provided to support a hang rail of rectangular cross section which is adapted to be supported in such a manner that other brackets may be secured along the length of the rail and have merchandise hung therefrom in cantilever fashion. The bracket is adapted to be secured to a vertical standard such as the conventional slotted ones and has a vertically extending notch disposed in a laterally offset distal end section fitting the hang rail, and the lateral section is parallel to a lateral side of the hang rail or bar and has a bumper member of yieldable material that presses against a side of the rail to hold the rail firmly in the notch. The distal end section is parallel to and laterally offset from the proximal end section by the length of the lateral section and provides a shape of the bracket that acts to rigidify the structure of the bracket and to stengthen the bracket.

10 Claims, 6 Drawing Figures

FIG. 1
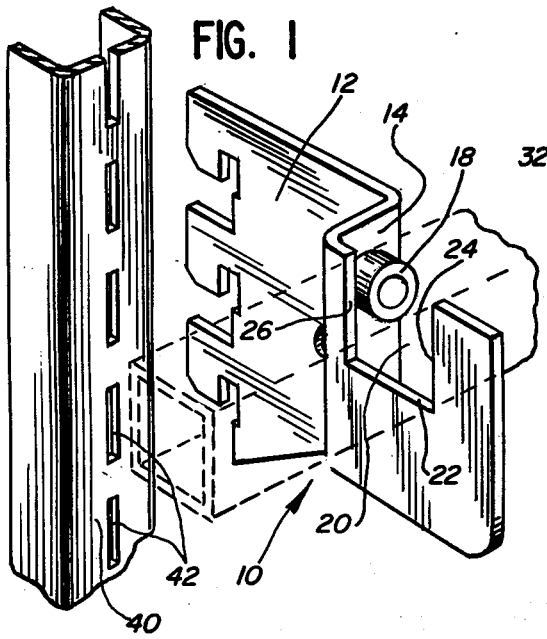
FIG. 2
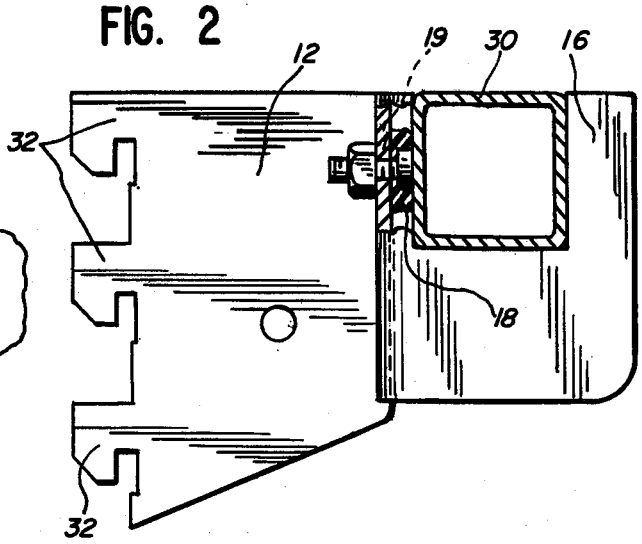
FIG. 3
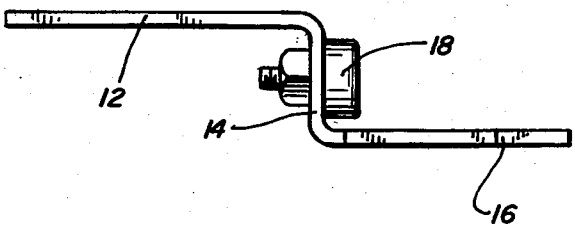
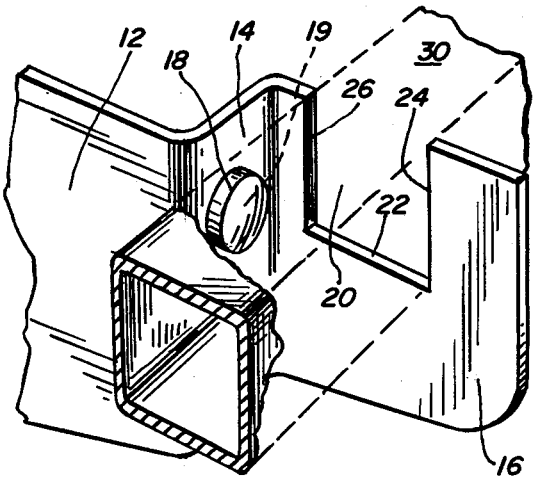
FIG. 4
FIG. 5
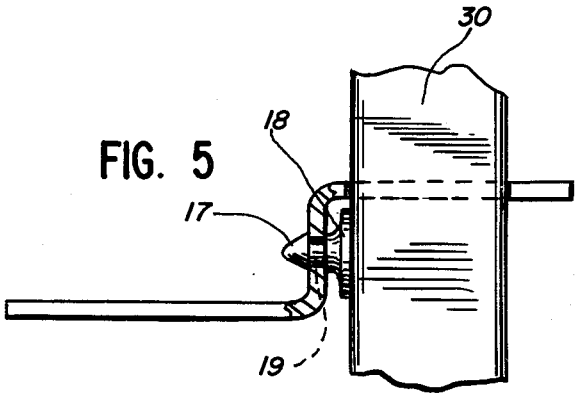
FIG. 6
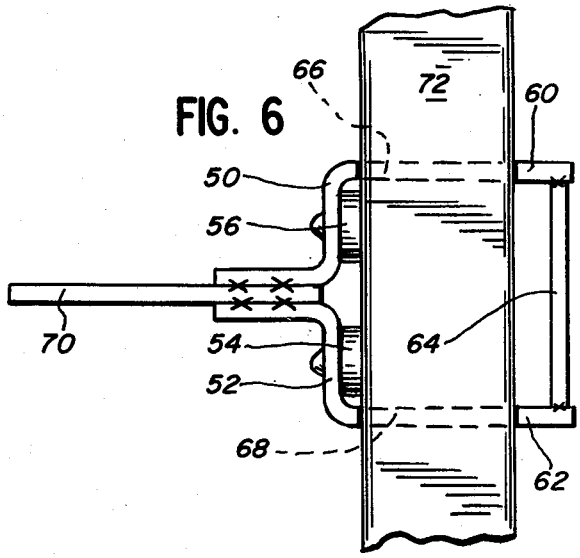

HANG RAIL SUPPORT AND HANG RAIL

CROSS-REFERENCE TO RELATED PATENT

The invention herein is an improvement over the subject matter disclosed in U.S. Pat. No. 4,316,546 granted Feb. 23, 1982 and entitled HANG RAIL SUPPORT AND HANG RAIL, said patent hereby being incorporated by reference herein and owned by the assignee hereof.

BACKGROUND OF THE INVENTION

This invention relates generally to a support structure and more particularly, to a hang rail support and bracket.

In Varon et al., U.S. Pat. No. 4,316,546, there is disclosed a hang rail support and bracket in which the bracket is to be supported at its proximal end from a vertical standard or the like and a rectangular hang rail is supported from the forward or distal end of the bracket for enabling merchandise to be hung from the rail. This invention is useful improvements in the general structure of hang rail and bracket disclosed in U.S. Pat. No. 4,316,546.

The invention herein eliminates many operations and complex dies for manufacture while providing an effective structure that achieves great strength.

The invention herein is directed to a structure which is simple, economical to manufacture and is highly effective to achieve the ends of providing for the support of a hang rail which is rectangular in cross section and which will not inadvertently move or twist when used for supporting merchandise.

SUMMARY OF THE INVENTION

A hang rail support and bracket in which the bracket is to be supported at its proximal end from a vertical standard or other means and a rectangular hang rail, in turn, is supported from the forward or distal end of the bracket for enabling merchandise to be hung from the rail.

The bar-supporting bracket member for supporting and firmly holding a generally rectangular cross-section load-supporting bar comprises an elongate bracket body have a proximal end section, a distal end section and a laterally bent section connecting said proximal section and the distal end sections, and the proximal end section having means to enable the bracket body to be mounted to a vertical support structure. The bracket body comprises a vertically arranged sheet metal member having an upper edge, the sheet metal member defining generally a vertical plane. The distal end section includes a notch spaced rearwardly from the distal end thereof, the notch having front and rear supporting edges and a bottom supporting edge and opening to the upper edge of the bracket body, the notch having substantially the same configuration as the cross-sectional configuration of at least substantially the lower portion of the hang rail or bar.

The laterally bent section extends generally perpendicular to the planes of the proximal end section and distal end section and a member of yieldable material is mounted on said laterally bent section facing the notch and having a thickness which is greater than the distance from the rear supporting edge of the notch and the said laterally bent section whereby said yieldable member interferes with the hang rail or bar when the same is pressed into said notch thereby frictionally resisting removal of the hang rail or bar and endwise movement thereof.

In a general sense, the bracket is in the form of an S-shaped member having relatively sharp bends. The connecting lateral portion of the S-shaped member serves two purposes; the bend adds strength to the bracket while at the same time providing the support for the yieldable means that holds the hang rail from twisting or inadvertent removal.

Modified structures are contemplated within the broad purview of the invention as disclosed herein.

BRIEF DESCRIPTION OF THE DRAWINGS

FIG. 1 is a perspective view of a bracket construction according to the invention, the hang rail being shown in phantom;

FIG. 2 is a side elevational view of the bracket and hang rail of FIG. 1;

FIG. 3 is a top plan view of the same bracket with the hang rail removed;

FIG. 4 is a perspective view of a slightly modified form of the invention shown with a square rail or bar in place;

FIG. 5 is a top plan view of the bracket and hang rail of FIG. 4; and

FIG. 6 is a top plan view similar to those of FIGS. 3 and 5 but of a further modified form of the invention.

DESCRIPTION OF THE PREFERRED EMBODIMENTS

The invention herein comprises the bracket of the invention independently and the bracket combination with a hang rail or bar of rectangular cross-section.

Referring to FIGS. 1 to 3, there is illustrated a preferred embodiment of the invention that is simple, economical to manufacture and is highly effective. The bracket 10 includes a proximal end section 12, a laterally bent section 14 and a distal end section 16.

A bumper member 18 is secured to the laterally bent section 14 in a suitable perforation 19 punched therein and is of a yieldable material such as an elastomeric material. Although not shown bumper 18 may take the form of a U-shaped member of suitable material and dimension to fit over the laterally bent section 14 for the same function of engaging the bar 30. In this event the opening 19 can be eliminated. A notch 20 is provided in the distal end section 16 to receive a bar 30. The notch 20 has a front supporting edge 24, a rear supporting edge 26 and a bottom supporting edge 22.

The bracket 10 is preferably formed from a single sheet metal stamping. Alternatively, the laterally bent section 14 and the distal end section 16 could be made without the proximal end section 12 and welded or secured otherwise to any of many types of support of any length.

The laterally bent section 14 is provided normal to the planes of the proximal end section 12 and the distal end section 16 by bending the sheet metal stamping at opposite 90° angles separated by the length of the laterally bent section 14. The shape of the bracket 10 acts to rigidify the structure of the bracket and to strength the bracket, As seen, the bracket assumes a somewhat S-shaped configuration.

The laterally bent section 14 is parallel to a lateral side of the bar or hang rail 30 when the latter is engaged in the notch 20 and is spaced rearwardly therefrom. The bumper member 18 may be press fitted into the perforation 19 or otherwise secured therein, such as by a rivet or bolt. The bumper member 18 has a sufficient thickness so that its facing surface extends past the plane of the rear supporting edge 26 of notch 20 and interferes with the bar or rail 30 as the latter is pushed into the notch 20.

The dimensions of the notch 20 correspond generally to the size of the bar or rail 30, the distance between the rear supporting edge 26 and the front supporting edge 24 being slightly greater than the transverse dimension of the bar or rail 30. The vertical depth of the notch 20 is preferably equal to the vertical dimension of the bar or rail 30 so that the upper face of the bar 30 is substantially flush with the upper edge of the bracket 10 as seen in FIG. 2 but this may not be essential in all cases.

The proximal end section 12 optionally is illustrated as having hooklike formations 32 by which the bracket can be secured to a vertical standard as the conventional type 40 having vertical slots 42. The standard 40 is usually mounted to a wall. Other means could be used to secure the bracket 10 to a vertical wall or support. The proximal end section 12 can have any selected length.

Referring to FIGS. 4 and 5, there is shown a mirror-image counterpart of the bracket 10 of FIG. 1 with a square cross-section bar 30 and a modified type of bumper 18. The notch 20 is square to accommodate the square cross-section bar 30. The bumper 18 is installed in the passageway or perforation 19 by distorting and pushing the tail part 17 through the perforation 19 while the head of bumper 18 seats against the laterally bent wall 14.

Referring to FIG. 6 there is illustrated a top plan view similar to those of FIGS. 3 and 5 but of a further modified form of the invention which is intended for relatively heavy support and it may be used where greater lateral stability is desired. The structure comprises two assemblies of lateral sections 50, 52 having bumpers 54, 56 secured thereto and distal end sections 60, 62 which are constructed for example, like the brackets 10 of FIGS. 1 and 4 connected together and mounted on a single member 70 adapted to be mounted to a standard or a wall. Each of the assemblies is a mirror configuration of the other. The distal end sections 60, 62 may be connected together by a welded link 64 but this is normally not required.

The distal end sections 60, 62 include notches 66, 68 adapted to receive the hang rail or bar 72, the latter of the type previously identified as 30.

It will be understood that the normal installation for mounting a hang rail would require two brackets of the constructions shown spaced apart a distance sufficient to provide stability. It is feasible, however, to have a single bracket of any of the constructions shown supporting one end of the hang rail while the other end is secured by any means to a wall or other vertical support.

Various modifications of the invention are capable of being achieved without departing from the spirit or scope of the invention as defined in the appended claims.

What it is desired to secure by Letters Patent of the United States is:

1. A bar supporting bracket for supporting and firmly holding a generally rectangular cross-section load supporting hang rail or bar and comprising:

A. an integral elongate bracket body of sheet metal formed as a generally S-shaped member but with relatively sharp bends whereby to provide a proximal end section and a distal end section offset laterally from one another and connected by a laterally bent center section, said end sections defining vertical parallel spaced planes, the center section being perpendicular to said planes and generally coextensive with said end sections, B. the proximal end section having means for enabling the bracket body to be mounted to a vertical support structure, C. said distal end section having a notch opening to the upper edge thereof, said notch having front, rear and bottom supporting edges, said notch having substantially the same cross sectional configuration as at least substantially the lower portion of the hang rail or bar adapted to be engaged therein, D. the rear supporting edge of the notch being adjacent the bend conneting the distal end section with the laterally bent section whereby when a hang rail or bar is engaged in said notch, the rear surface of the hang rail or bar will be spaced slightly from and parallel with the front surface of said center section, and E. a yieldable bumper member mounted to the front surface of said laterally bent center section and having a thickness when not compressed which is greater than the space between said front surface and the installed hang rail or bar so that when the latter is installed the same will interfere with said bumper member and thereby be frictionally engaged to resist removel from or endwise movement in said notch.

2. The bracket as claimed in claim 1 and which said yieldable bumper member is formed of an elastomeric material.

3. The bracket as claimed in claim 1 wherein said laterally bent center section includes a perforation for mounting said yieldable bumper member.

4. The bracket as claimed in claim 1 which comprises a pair of said bracket bodies identical but mirror configurations of one another, spaced apart whereby to provide two laterally bent center sections each having said yieldable bumper member, two distal end sections each having a notch, the hang rail or bar being engaged in both notches and engaged by both bumper members, said bracket bodies being coupled together and means to enable them to be mounted to a vertical support structure common to both bracket bodies.

5. A bar-supporting bracket member for supporting and firmly holding a generally rectangular cross-section load supporting bar comprising:

A. an elongate bracket body having a proximal end section, a distal end section and a laterally bent section connecting said proximal end section and said distal end section by means of bends, said proximal end section having means to enable said bracket body to be mounted to a vertical support structure, B. said bracket body comprising a vertically arranged sheet metal member having an upper edge, the sheet metal member defining generally a vertical plane, C. said distal end section including a notch spaced rearwardly from the distal end thereof, said notch having front and rear supporting edges and a bottom supporting edge and opening to the upper edge of the bracket body, said notch having substantially the same configuration as the cross sectional configuration of at least substantially the lower part of the hang rail or bar, D. said laterally bent section extending generally perpendicular to the planes of the proximal and distal end generally coextensive therewith and E. a member of yieldable material mounted on said lateral section facing said notch and having a thickness which is greater than the distance from said rear supporting edge of said notch and the said laterally bent section whereby said yieldable member interferes with the hang rail or bar when the same is pressed into said notch thereby frictionally resisting removal of the hang rail or bar and endwise movement thereof.

6. A support assembly including a rectangular cross-section hang rail or bar extending between and supported by spaced apart brackets said hang rail and bar being subject to rotational forces during the use thereof and said support assembly serving to resist said force, said assembly including the hang rail or bar in combination with said brackets for supporting same, and each bracket comprising:

A. an elongate bracket body having a proximal end section, a distal end section and a laterally bent section connecting said proximal section and said distal end section by means of bends, said proximal end section having means to enable said bracket body to be mounted to a vertical support structure, B. said bracket body comprising a vertically arranged sheet metal member having an upper edge, the sheet metal member defining generally a vertical plane, C. said distal end section including a notch spaced rearwardly from the distal end thereof, said notch having front and rear supporting edges and a bottom supporting edge and opening to the upper edge of the bracket body, said notch having substantially the same configuration as the cross sectional configuration of at least substantially the lower part of the hang rail or bar, D. said laterally bent section extending generally perpendicular to the planes of the proximal and distal end sections, E. a bumper member of yieldable material mounted on said laterally bent section generally coextensive therewith facing said notch and having a thickness which is greater than the distance from the rear supporting edge of said notch and the said laterally bent section whereby said yieldable member interferes with the hang rail or bar when the same is pressed into said notch thereby frictionally resisting removal the hang rail or bar and endwise movement thereof, and F. the hang rail bar adapted to be engaged into the notch of each bracket with its lower face resting on the bottom support edge and its side faces substantially juxtaposed closely to the respective front and rear support edges if not engaging the same.

7. The bracket as claimed in either claim 5 or 6 and which said member of yieldable material is an elastomeric material.

8. The bracket as claimed in claims 5 or 6 wherein said laterally bent section is longer than the horizontal dimension of said notch and is formed in said bracket body by two right angle bends whereby said proximal end section and distal end section are substantially parallel.

9. A support assembly as claimed in claim 6 in which said bracket comprises a pair of said bracket bodies identical but mirror configurations of one another, spaced apart whereby to provide two laterally bent sections having bumper members, two distal end sections each having a notch, the hang rail or bar being engaged in both notches and engaged by both bumper members, said bracket bodies being coupled together and means to enable them to be mounted to a vertical support structure common to both bracket bodies.

10. A supporting bracket for a generally rectangular cross-section hang rail or bar which is adapted to extend between the bracket and at least one other support, said bracket comprising:

A. an elongate bracket body having a proximal end section, a distal end section and a laterally bent section connecting said proximal end section and said distal end section by means of bends, said proximal end section having means to enable said bracket body to be mounted to a vertical support structure, B. said bracket body comprising a vertically arranged sheet metal member having an upper edge, the sheet metal member defining generally a vertical plane, C. said distal end section including a notch spaced rearwardly from the distal end thereof, said notch having front and rear supporting edges and a bottom supporting edge and opening to the upper edge of the bracket body, said notch having substantially the same configuration as the cross sectional configuration of at least substantially the lower part of the hang rail or bar, D. said laterally bent center section extending generally at right angle to the planes of the proximal end section and distal end section and substantially coextensive with said end sections, E. a member of yieldable material mounted on said laterally bent section facing said notch and having a thickness which is greater than the distance from said rear supporting edge of said notch and the said laterally bent section whereby said yieldable member interferes with the hang rail or bar when the same is pressed into said notch thereby frictionally resisting removal of the hang rail or bar and endwise movement thereof and F. the hang rail bar adapted to be engaged into the notch with its lower face resting on the bottom support edge and its side faces substantially juxtaposed closely to the respective front and rear support edges if not engaging the same.

* * * * *